United States Patent [19]

Saligny

[11] Patent Number: 4,526,434

[45] Date of Patent: Jul. 2, 1985

[54] CONNECTING ELEMENT

[75] Inventor: Yves Saligny, Cluses, France

[73] Assignee: Carpano & Pons, France

[21] Appl. No.: 619,687

[22] Filed: Jun. 13, 1984

Related U.S. Application Data

[63] Continuation of Ser. No. 366,752, Apr. 8, 1982, abandoned.

[30] Foreign Application Priority Data

Apr. 16, 1981 [FR] France ..... 81 07661

[51] Int. Cl.[3] ..... H01R 9/08; H01R 4/24

[52] U.S. Cl. ..... 339/99 R; 339/97 R; 339/98

[58] Field of Search ..... 339/97 R, 98, 99 R, 339/97 P

[56] References Cited

U.S. PATENT DOCUMENTS

| | | | |
|---|---|---|---|
| 3,804,971 | 4/1974 | Bazille, Jr. | 339/98 X |
| 3,880,489 | 4/1975 | Dauser, Jr. | 339/98 |
| 3,936,128 | 2/1976 | D'Annessa et al. | 339/98 |
| 4,099,822 | 7/1978 | Carlisle | 339/98 |
| 4,284,316 | 8/1981 | DeBaigt | 339/98 |
| 4,341,430 | 7/1982 | Crawford | 339/99 R |

FOREIGN PATENT DOCUMENTS

| | | | |
|---|---|---|---|
| 1131773 | 10/1968 | United Kingdom | 339/98 |
| 1293970 | 10/1972 | United Kingdom | 339/98 |
| 1373138 | 11/1974 | United Kingdom | 339/98 |
| 2047984 | 12/1980 | United Kingdom | 339/98 |
| 2097201 | 10/1982 | United Kingdom | 339/99 R |

*Primary Examiner*—William R. Briggs

*Attorney, Agent, or Firm*—Kane, Dalsimer, Kane, Sullivan and Kurucz

[57] ABSTRACT

The invention relates to a connecting element consisting of a plate whose faces operate on either side of at least one automatically stripping connecting plug, in conjunction with an electrical conductor, in order to ensure the connection of the latter into the said plug. The plate consists of two faces through which two passages are provided, of sufficient dimensions to allow the conductor to pass through. These passages have two opposite edges arranged in the direction in which the plate is pushed in. The first edge is directed towards the free ends of the faces, in order to work in conjunction with the conductor when the latter is connected. The second edge which is opposite is provided in order to ensure the disconnection of the said conductor out of the plug, when the plate is withdrawn in the direction 18. An element of this kind can be used especially for connecting and disconnecting wires of telecommunication lines, on distributors or subdistributors.

2 Claims, 18 Drawing Figures

CONNECTING ELEMENT

This is a continuation of parent application Ser. No. 366,752, filed Apr. 8, 1982, now abandoned.

The present invention is concerned with connecting elements, especially for telecommunication lines, in the form of plates which are mostly single or double. The sides of these plates are provided in such a manner as to work in conjunction with an electrical conductor, on either side of at least one automatically stripping connecting plug, in order to ensure the connection of this electrical conductor with the said plug when the plate is pressed on to the plug, in the direction of the sides.

In known connecting elements of this type, such as the one described in the French patent application No. 80 26 161 filed by the applicant, only simplified means are provided which make it possible to connect electrical conductors at the same time in a corresponding number of automatically stripping plugs. To achieve this the conductors must first of all be arranged in the input, which is conical in this example, of their respective plugs, and the connecting element is subsequently introduced forcibly on to the said plugs by using clamping screws. Nothing is provided for extracting the connecting element or elements and the conductors for which they were used for connecting on to the automatically stripping plugs. Nor is anything provided for keeping the conductors firmly in immediate proximity to their respective plugs, which can be a drawback especially when the automatically stripping plugs are supported by a housing which must be directed in several directions in order to make it possible to connect several conductors on to it.

The connecting element, consisting of a plate, includes, according to the invention, faces which are crossed from one side to the other respectively by passages which are sufficiently large to allow the corresponding electrical conductor to pass through. These passages have two edges arranged opposite according to the direction in which the plate is pushed in. The first edge of these passages, which is directed towards the free end of the faces, is provided in such a way as to operate in conjunction with the conductor when the latter is connected. The second edge of these passages is provided in such a manner as to ensure the disconnection of the said conductor out of its plug, when the plate is removed.

The present invention proposes to make it possible to achieve connecting elements which are able to achieve the instantaneous connection and disconnection of an insulated electrical conductor in a simple manner on an automatically stripping connection plug, without its being necessary to use a special tool for this purpose, whilst improving the holding of each conductor in its automatically stripping plug in such a manner as to prevent any inopportune disconnection by tearing out.

Certain particularly advantageous forms of execution even have certain additional advantages: guiding of the electrical conductor is improved when it is connected in the plug; the cutting of the superfluous end part of the conductor which projects beyond the plug after connection, is more easily carried out especially when the automatically stripping plugs are arranged in rows which are close to one another, and when the space between two successive rows is thus reduced.

The present invention likewise relates to connecting devices which consist of plates which form the object of the present invention, these plates working in conjunction with automatically stripping connecting plugs arranged according to at least one alignment on an insulating housing.

The connecting device according to the invention, consists of an elastic locking device of the plate on the insulating housing; the purpose of this device is to make a limited withdrawal of the plate possible as far as a second, withdrawn position in which the conductor is disconnected from its plug. The lateral disengagements of the passages emerge in such a manner that they make it possible to introduce and withdraw conductors whilst the plate occupies its second withdrawn position. Moreover, in certain modes of execution, the space between two adjoining plates arranged on the same alignment of plugs, is sufficient to allow the electrical conductor to pass freely, and to be used to guide it until the disengagement is opened. Finally, a cutter blade, which is integral with the insulating housing is arranged advantageously on the trajectory according to which each plate is pushed in, along the corresponding plug. The active part of each blade is arranged at such a level that it cuts the corresponding conductor, after the latter has been pushed in.

The present invention thus makes it possible to achieve a connection device of a very simple and compact structure, which makes it possible, without special tooling, to connect one or several conductors, and, at the same time, to cut the superfluous ends of the said conductors, its being just as easy to achieve the disconnection of the same conductors without the plates running the risk of being lost when they are withdrawn to make the said disconnection possible.

The attached drawing shows, as an example, methods of execution of the connecting elements and connecting devices in accordance with the present invention.

FIG. 3 shows in a cross section III—III of FIG. 1 the same first method of execution.

Figure 15A:
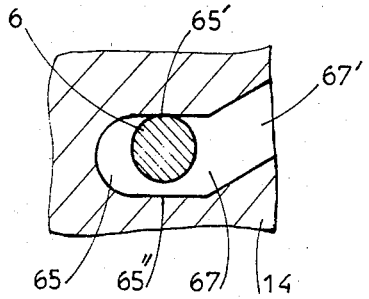
FIG. 15 shows, viewed from the left hand side of FIG. 13, the same first method of execution.
Figure 15:
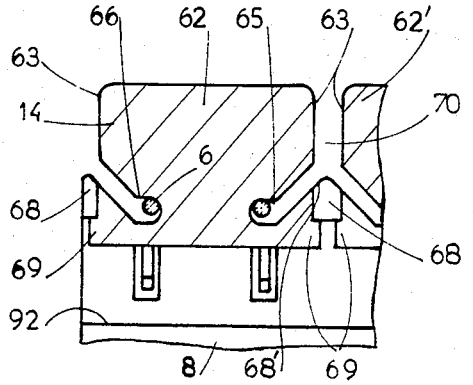

FIG. 15*a* shows, a detail of FIG. 15 on a larger scale.

Figure 16:
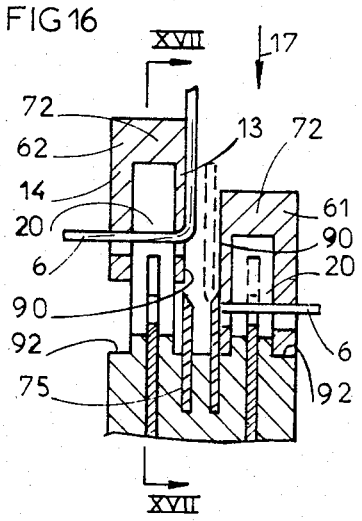
Figure 17:
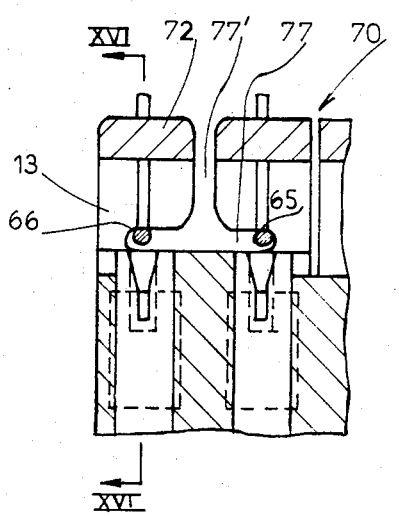

FIG. 16 shows, in a cross section XVI—XVI of FIG. 17, a second method of execution of the connecting device.

FIG. 17 shows, in cross section XVII—XVII of FIG. 16, the same second method of execution.

As shown in FIGS. 1–4 the connecting element which consists of a simple plate, is made, for example, from a single piece of moulded insulating material. FIGS. 1–4 show two plates 1 and 2 arranged face to face, each spanning two automatically stripping connecting plugs 3 and 4 respectively. In this example, each plug 3, 4, has a narrow slot 5 whose purpose is to clamp the conducting core of an insulated electrical conductor 6. Each slot 5 has advantageously a conical input 7 whose purpose is to facilitate the introduction of a conductor 6. The plugs 3 form an alignment of plugs 3'. The plugs 4 form an alignment 4' parallel to 3'. These two alignments of plugs are supported by an insulating housing 8 whose extensions 11 form insulating chambers which surround the plugs 3, 4 except in the immediate vicinity of their slot 5. Each plate 1, 2 includes two parallel faces 13, 14 (FIG. 1) each of which includes two passages 15, 16 (FIGS. 2 and 3) which pass through them, and which are sufficiently large for each to allow a conductor 6 to pass through. The two passages 15, which are provided in order to allow the same conductor 6 to pass through are aligned together and arranged in such a manner as to be aligned with a slot 5, when the plate is pushed on to its plugs. The same applies to the passages 16. In this method of execution, the passages 15, 16 are closed over their whole periphery and are cylindrical. Each passage 15, 16 includes a first edge 15', 16' respectively (FIGS. 1 and 2) directed towards the free end 13', 14' respectively of the face 13 and 14, in order to work in conjunction with the conductor 6 on connection of the latter. It also includes a second edge, 15", 16" respectively, which is opposite to the first, which is provided in order to ensure the disconnection of the conductor 6 from the corresponding plug, when the plate is withdrawn in the direction 18.

In this method of execution, the first edges 15' of the two aligned holes 15 are connected together by a common extension 20, which is arranged at the same level as these, directed in the direction 17 in which the plate 1 is pushed in, and its purpose is to extend across the slot 5 of the automatically stripping connecting plug 3, parallel to the place occupied by the conductor 6, when it is connected into the said plug 3. An identical extension 20 connects the first edges 16' of the two passages 16 which are aligned with one another.

The passages 15 and 16 which pass through the face 13 emerge facing the first end 21' of two channels 21 respectively, which are provided longitudinally according to 17–18 along the face 13, and emerge approximately on the two ends of the latter. On its second end 21" opposite to the first, each channel 21 includes methods of locking the free end 6' of the conductor 6, which is to be cut off. These locking means are formed in this example by a tilted slot 22 which emerges on the one hand into the channel 21, on the other hand on the end 24 of the connecting part 23 of the two faces 13, 14 of the plate 1. The width of this slot 22 is such that the insulation of the conductor 6 is slightly clamped there and is thus locked.

Each plate 1, 2 consists of at least one profiled part shaped in such a manner as to make it easy for it to be pulled in the direction 18 and simultaneously to achieve the disconnection of the conductor 6 from the corresponding plug. In this example, the profiled part consists of a groove 25 (FIG. 1) which is provided in the connecting part 23 and whose purpose is to accommodate, for example, a screwdriver blade.

In order to achieve the connection of two conductors 6 on two plugs 3 arranged side by side, it is necessary to introduce in the direction 26 (FIGS. 1 and 4) the two conductors 6 into the holes 15 and 16, and then to bend the free ends of these conductors in the direction 18 by housing each one, first of all in a channel 21, and then in a locking slot 22. The plate 1 is then pushed in, in the direction 17, spanning two plugs 3 arranged side by side, the conical inputs 7 working together to obtain a good centering of the conductors 6 facing the slots 5. A stronger pressure in the direction 17 on the end 24 of the connecting part 23, exerted for example with one finger of the hand or with some push button device, finally brings the two conductors 6, which are clamped in their respective slots 5, into the position shown in FIGS. 1 and 2. At the same time, the insulation of the conductors has been torn out and the connections have been established.

These are the first edges 15' and 16', as well as their common extensions 20 situated at the same level which have thus forcibly pushed in the two conductors 6.

It only remains to cut the end 6' of each conductor 6 with some kind of pincers close the end 24 of the connecting part 23.

In order to disconnect the same conductors 6, it is sufficient to insert for example a screwdriver blade into the groove 25 and to pull in the direction 18. The plate 1 is thus withdrawn in order to be finally removed from the two plugs 3 on which it was previously pushed in a span arrangement. At the same time, the second edges 15" and 16" of the passages 15 and 16 have drawn the two conductors 6 in the direction 18 so that they are disconnected from their plugs 3. Other conductors 6 can thus be connected easily in their place, for example.

Figure 5:
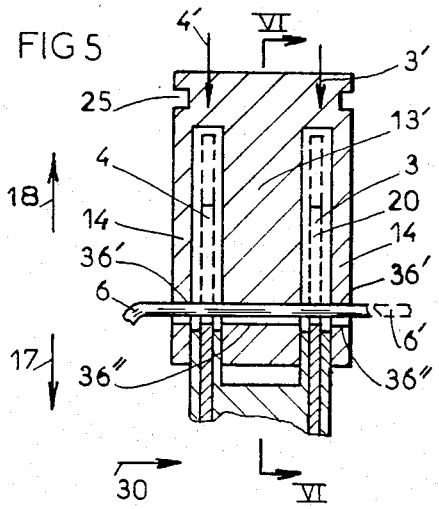
FIG. 5 shows, viewed in a cross section V—V of FIG. 6, a second method of execution of the connecting element.
Figure 6:
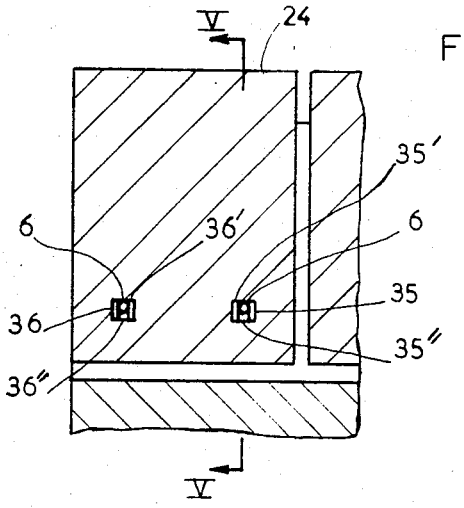
FIG. 6 shows in a cross section VI—VI of FIG. 5 the same second method of execution.

In the second method of execution, shown in FIGS. 5 and 6, the connecting element consists of a double plate which makes it possible to effect the connection of two conductors 6, on two plugs 3 arranged side by side, forming part of the alignment 3', and on two plugs 4 arranged side by side face to face with the preceding ones, forming part of the alignment 4'. Each of the three faces of this double plate, two faces 14 and one common face 13' includes two passages 35 and 36 respectively, which pass through it (FIG. 6). The purpose of the three aligned passages 35 is to accommodate a first conductor 6 which will be connected at the same time to a plug 3 and to the plug 4 arranged facing the latter. The purpose of the three aligned passages 36 is to accommodate the second conductor 6 which will be likewise connected at the same time to a plug 3 and to the plug 4 which is arranged facing the latter. In this example, the passages 35 and 36 closed over their whole periphery have a square cross section.

The channels 21 and the locking slots 22 of the first method of execution (FIGS. 1–4) are eliminated. All the other constituent elements are identical to those of the first method of execution. The operation of the whole unit is similar to that of the first method of execution. Each conductor 6 is introduced in the direction 30 into the passages 35 and 36 respectively, which are provided through the two faces 14 and the face 13'. A pressure in the direction 17 makes it possible to connect the two conductors 6, each to a plug 3 and a plug 4, the first edges 35' and 36' of the passages 35 and 36, as well as the extensions 20, respectively pushing the two conductors into the corresponding slots 5. It is then sufficient to cut the superfluous end 6' of each of the conductors 6, with pincers.

The disconnection of the two conductors 6 is carried out by pulling the double plate in the direction 18, the second edges 35'' and 36'' of the passages 35 and 36, simultaneously drawing out the conductors 6 out of the slots 5, in which they were clamped.

Figure 7:
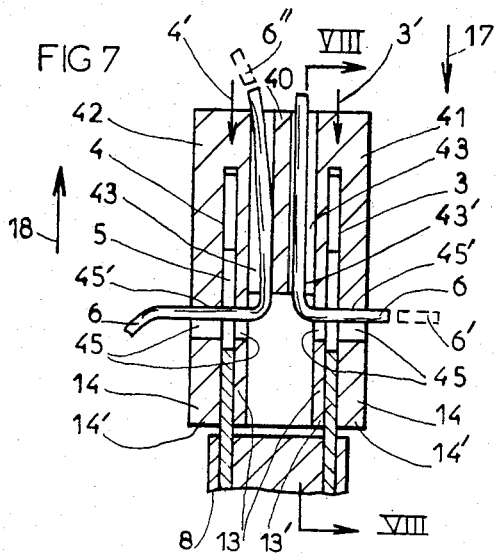
FIG. 7 shows, in a view VII—VII of FIG. 8, a third method of execution of the connecting element.
Figure 8:
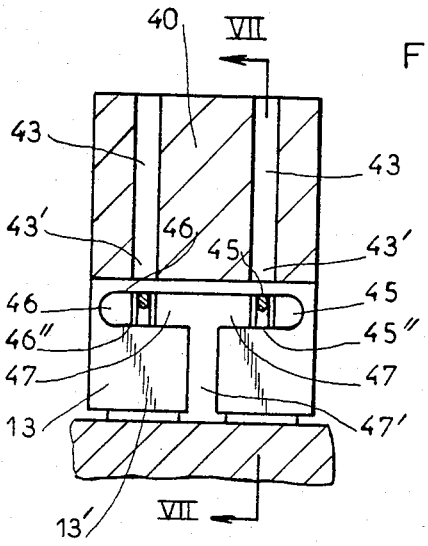
FIG. 8, shows in a view VIII—VIII of FIG. 7, the same third method of execution.
Figure 9:
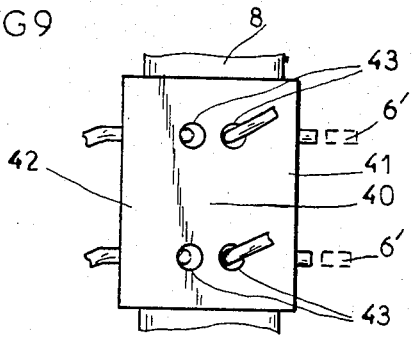
FIG. 9 shows, in a view of FIG. 7, from above, the same third method of execution.

The FIGS. 7–9 show a third method of execution of the connecting element, consisting of a double plate which makes it possible to carry out the connection of four conductors 6, respectively on two plugs 3 arranged side by side forming part of the alignment 3' and on two plugs 4 arranged side by side, facing the preceding ones, forming part of the alignment 4'. The two simple plates 41 and 42 which form the double plate are held side by side by a part in the form of a bridge 40. The two outer faces 14 and the two inner faces 13 adjacent to the bridge 40 each include a passage 45 and a passage 46 which pass through them. The two passages 45 and the two passages 46 passing through the two faces 13 emerge facing the first end 43' of the two holes 43 respectively, which are provided on either side in the said bridge 40, along the two faces 13 adjacent to the bridge 40. In this method of execution the passages 45 and 46 each have a lateral bent disengagement 47 which emerges on the free end 13', 14' of the faces 13, 14. The elbow bend part 47' of the disengagements of the two passages 45 and 46 passing through the same face is advantageously common to the two disengagements 47. All the other constituent elements are identical to those of the second method of execution (FIGS. 5 and 6).

The functioning of the whole unit is similar to that of the preceding methods of execution. Whilst the double plate 41–42 is separated from the plugs 3–4 and the housing 8, there are two possibilities of introducing the conductors 6.

As indicated for the plate 41 (FIG. 7), the conductor 6 can be introduced in the direction 17 into the hole 43, and its free end 6' can be folded into the elbow bend disengagement 47'–47, then pushed back laterally into the corresponding passage 45 and 46. As indicated for the plate 42 (FIG. 7) the conductor 6 can be introduced in the direction 18 into the hole 43, its part opposite its free end 6'' being itself subsequently introduced into its elbow bend disengagement 47'–47 and into one of the passages 45 or 46. A pressure in the direction 17 makes it possible to connect the four conductors 6, two of them to plugs 3 and two of them to plugs 4. The first edges 45' and 46' of the passages 45 and 46 push the four conductors 6 into the corresponding slots 5 in the direction 17. It subsequently only remains to cut the superfluous free ends 6' and 6'' of the conductors 6 according to the case. In this method of execution, the extensions 20 have been eliminated for the first edges 45' and 46' are supported against the conductors 6 in the immediate vicinity of the plugs 3, 4 the chambers 11 surrounding the plugs 3, 4 being eliminated in this example.

The disconnection is carried out by pulling in the direction 18 on the double plate 41–42. As in the preceding cases, the second edges 45'', 46'' of the passages 45 and 46 simultaneously pull the conductors 6 out of the slots 5.

Figure 10:
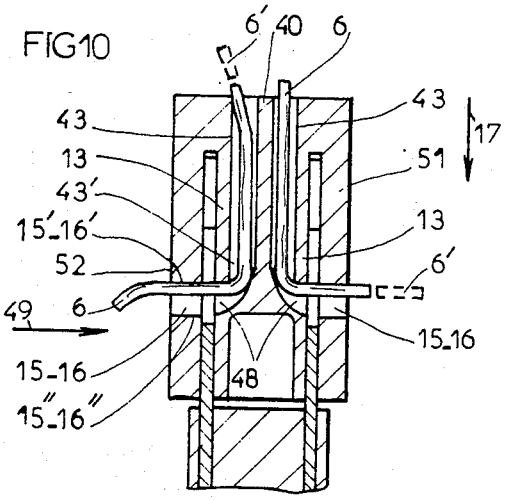
FIG. 10 shows, according to a view similar to FIG. 7, a fourth method of execution of the connecting element.

The fourth method of execution, shown in FIG. 10 is similar to the third method of execution (FIGS. 7–9). It consists of holes 43 provided in the bridge shaped part 40, but the passages 45 and 46 are replaced by passages that are closed over their periphery which are similar to the passages 15 and 16 of the first method of execution (FIGS. 1–4). Moreover it includes a guiding hole 48, which is curved inwards, arranged between the first end 43' of each hole 43 provided along one of the faces 13, and the end of the corresponding passage 15 or 16.

As in the previous method of execution, the free end 6' of the conductors 6 can be introduced, either according to 17 into the hole 43 of the plate, 51, in this example, in the direction 49 into the passage 15 or 16, of the plate 52 in this example, the incurved guiding hole 48 ensuring the internal guiding of the conductor 6 until the free end 6' of the latter emerges again through the corresponding passage 15 or 16 through the corresponding hole 43 respectively. The connection and if necessary the disconnection of the conductors 6 is then carried out as indicated in the third method of execution (FIGS. 7–9).

Figure 11:
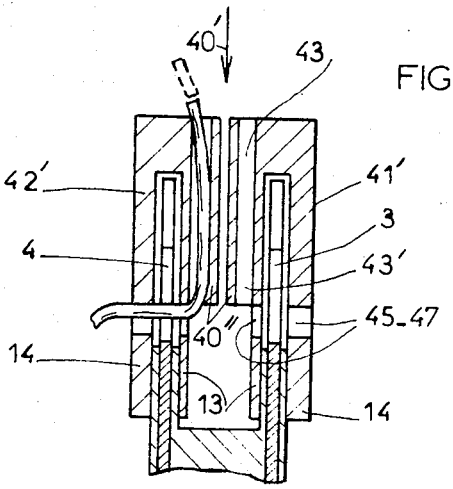
FIG. 11 shows, in a cross section XI—XI of FIG. 12, a fifth method of execution of the connecting element.
Figure 12:
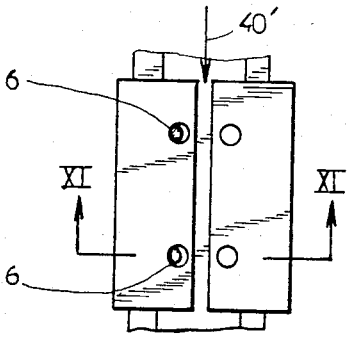
FIG. 12 shows, in a view of FIG. 11 from above, the same fifth method of execution.

FIGS. 11 and 12 show a second method of execution of the connecting element, consisting of a single plate, which makes it possible, in this example, to connect two conductors 6 on to two plugs 3 or on to two plugs 4 arranged side by side on the same alignment of plugs. Each plate 41', 42' is in fact formed like each of the plates 41, 42 which form the double plate of the third method of execution (FIGS. 7–9) imagining that the part 40 in the form of a bridge (FIG. 9) was cut off in its central part, into 40' (FIGS. 11 and 12). Thus each plate 41', 42' consists of two aligned passages 45, two aligned passages 46, two elbow-bend disengagements 47 and two holes 43. Each passage 45, 46 which passes through the face 13 of each plate 41', 42' thus emerges facing the first end 43' of the hole 43 which is provided longitudinally in an extra thickness 40'' of the said face 13, formed by part of the bridge 40. This hole 43 thus emerges on to the two opposite ends of the said extra thickness 40''. Each plate hence makes it possible to connect, and if necessary subsequently to disconnect, two conductors 6 in the manner previously described in the third method of execution (FIGS. 7–9).

Figure 13:
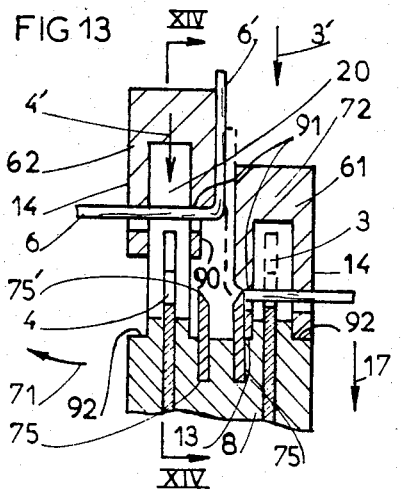
FIG. 13 shows, in a cross section XIII—XIII of FIG. 14, a first method of execution of the connecting device.
Figure 14:
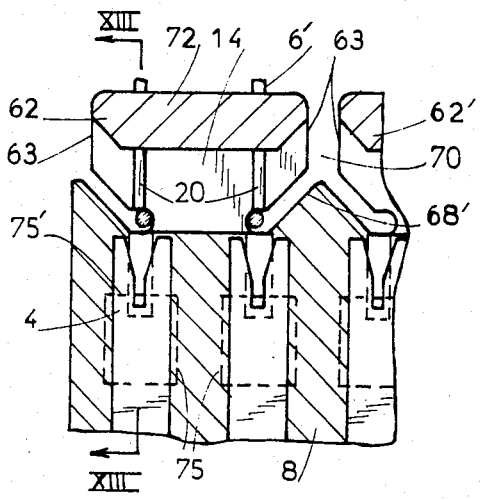
FIG. 14 shows, in a cross section XIV—XIV of FIG. 13, the same first method of execution.

The FIGS. 13–15 represent a first method of execution of a connecting device, consisting of plates according to the present invention. These plates 61, 62, which are simple plates, are in fact identical as in the case of FIGS. 1–4 and 11–12. Each of them works in conjunction with two automatically stripping plugs 3 or 4 arranged respectively according to alignments 3', 4' on the housing 8. Each plate 61, 62 includes an elastic locking device of the said plate on the housing 8. This elastic device consists of at least one of the faces 14, for example, of the plate, a face which is flexible towards the inside in the direction 71, (FIG. 13) in such a manner as to make it possible for the plate to be introduced according to 17, in spite of the presence of two stops in relief 68 (FIG. 15) which are integral with the housing 8, arranged either side of the face 14 and whose purpose is to work in conjunction with the two corresponding nozzles 69 of the face 14. The elastic locking device thus makes a limited withdrawal possible of the plate 61, 62, in the direction 18, up to a second withdrawn position (FIGS. 13–15), in which the conductors 6 are disconnected from their respective plugs 3 or 4, without the plates 61 or 62 being completely removed from out of the said plugs.

In this method of execution, the passages 65, 66 (FIGS. 15 and 15*a*) passing through faces 13, 14 of each plate 61, 62 each present a lateral disengagement 67 which emerges on to one of the sides 63 of the faces. In the present example, a part 67′ of each lateral disengagement is tilted in the direction of the connecting part 72 of the faces 13, 14 of the plate. Each lateral disengagement 67—67′ emerges on the corresponding side 63 of a face 13, 14 at a level which is such that when the plates 61, 62 occupy their second withdrawn position, the opening of the tilted part 67′ of the detachment 67 is arranged on this side of the connecting part 72 of the adjoining plate which has been pushed in 61′, 62′ respectively. The space 70 between the two adjoining plates 61, 61′ or 62, 62′ arranged on the same alignment of plugs is sufficient to allow the electrical conductor 6 to pass freely and to serve as its guide up to the opening of a detachment 67, 67′. This space 70 between two adjoining plates is interrupted by a conical part in relief 68′ (FIGS. 14 and 15) of the housing 8. This conical part 68′ is an extension of the tilted parts 67′ of the two detachments 67 which emerge respectively on the sides 63, arranged facing one another, of the two sides 14 of the adjoining plates 61, 61′ and 62, 62′.

A cutting blade 75 which is integral with the insulating housing 8, is arranged on the trajectory 17 along which each plate 61, 62 is pushed in on one side of the corresponding plug 3, 4 facing the slot 5 of the latter and parallel to the said plug. The active part 75′ of each cutting blade 75 is arranged at a level which is such that it cuts the corresponding conductor 6 at the latest at the end of the latter being pushed in. In this example it cuts the conductor 6 approximately at the end of the latter being pushed in and the level of the active part 75′ is the one occupied by the first edges 65′, 66′ of the passages 65, 66. In this example, the cutting blade 75 is arranged in such a manner that, when the plate 61, 62 occupies its pushed in position on the corresponding plug 3, 4, it is found to be arranged along the external face 90 of one 13 (FIG. 13) of the faces of the said plate. Moreover, this external face 90 supports a part in relief 91 (FIG. 13) against which the active part 75′ of the blade 75 is in contact, when the plate 61, 62 occupies the pushed in position. This part in relief 91 is advantageously aligned with the first edges 65′ and 66′. The position in which the plate 61, 62 is pushed in is determined for example by a stop 92 which is integral with the housing 8, this stop working then in conjunction with the free end of the face 14.

After each plate 61 or 62 has been pushed into position on its two plugs 3 and 4, by elastic deformation of its face 14, it is brought into the withdrawn position (FIGS. 13–15). Each conductor 6 is then introduced laterally in the direction 17 into the space 70 then into the tilted part 67′, of a detachment 67 then into the corresponding passages 65 or 66, its superfluous free end 6′ being simultaneously folded in the direction 18 in the case in which a plate is already pushed into the adjoining alignment of plugs (FIG. 13). A pressure in the direction 17 exerted on the connecting part 72 then brings the plate 61 or 62 into the pushed in position, the active part 75′ of the cutting blade 75 cutting the free end 6′ at the superfluous free end 6′ of the conductor 6 at the end of travel of the said plate.

If a plate is pulled in the direction 18 this plate is brought into the withdrawn position, its noses 69 coming to rest against the stops 68, the conductors 6 being simultaneously pulled out of their respective slots. It is noted that, as the conductors 6 are pulled out of their respective slots, the second respective 65″, 66″ of the passages 65, 66 come to rest against a conductor 6, on either side of the corresponding plug 3, 4. Each conductor 6 is thus pulled in the direction 18 while remaining arranged approximately perpendicularly to its plug 3, 4 which avoids any inopportune wedging of the said conductor 6 or of its insulating sheathing.

It must also be noted that, in the previously described method of execution (FIGS. 1–12), the second edges of the passages act on the conductor 6, advantageously simultaneously either side of the corresponding plug 3, 4, when the said conductors 6 are pulled out.

Without going outside the framework of the present invention, each lateral disengagement 67, whether or not it includes a tilted part 67′, of a passage 65 or 66, could emerge on to a side 63 of the face 14, at a level which is such that, when the plate occupies its second, withdrawn position, the opening of the detachment 67 is arranged beyond the connecting part 72 of the adjoining pushed in plate. Owing to this the space 70 between two adjoining plates 62, 62′ is useless, as well as the conical part in relief 68′. This variant is not shown in the drawing.

FIGS. 16 and 17 show a second method of execution of the connecting device, consisting of plates in accordance with the present invention. The disengagements 67 of the preceding method of execution (FIGS. 13–15*a*) are replaced by lateral disengagements 77 which include an elbow bend part 77′, which is advantageously common, emerging through the connecting part 82 of the faces 13, 14 of the plate. The space 70 between two adjoining plates is almost totally eliminated, as well as the conical parts 68′. In this method of execution, the part in relief 91 of the external face 90 of the face 13 is eliminated and the active part 75′ of each cutting blade 75 is arranged at a level which is such that it cuts the corresponding conductor 6 before the latter is completely pushed in. All the other elements are identical to those of the preceding method of execution (FIGS. 13–15).

The introduction of the laterally arranged conductor 6 is carried out in the direction 17 in the elbow bend part 77′ of the disengagement 77. Connection and disconnection of the conductors 6 are carried out subsequently as described in the preceding method of execution.

Without going outside the framework of the present invention, each of the plates, simple or double could be designed to connect or disconnect at the same time, not two conductors on to two plugs of the same alignment as in the case in all the previously described methods of execution, but a larger number of conductors, or on the other hand a single conductor. It is to be noted that the plates, according to the invention, are of particular interest especially in the case when they are used to connect a small number of conductors by exerting a relatively slight pressure on them in order to push them in and carry out the connection and if necessary to withdraw them to carry out the disconnection by exerting a pulling force in the opposite direction.

The connecting elements and the connecting devices using the said elements which are the object of the invention, can be used for example to carry out connections and disconnections of wires, in distributors and sub-distributors used in telecommunications.

What is claimed is:

1. A connector comprising a plurality of assemblies arranged in pairs, each assembly comprising:

a. a plate having a connecting part;

two opposed members affixed to said connecting part and having faces terminating in a free side respectively;

a passageway extending through said faces and defined by a first edge formed in the respective faces directed toward said free side and a second edge opposing said first edge;

an operating groove on one of said faces; and engaging means; and b. a plug being constructed and arranged to be captured between said faces by said engaging means in a first position and having a conducting element adapted to engage and strip a wire disposed in said passageway when said plug is pushed into a second position toward said connecting part and to disengage from said wire when said plug is in said first position; the plates of each assembly being disposed in parallel with each other;

two adjacent assembly pairs being separated by a lateral slot communicating with the respective passageways of the adjacent assembly plates;

whereby a wire is inserted into the assembly by passing it from the direction of said connecting part through said lateral slot to said passageway, while said plug is in said first position; and moving said plug into said second position so that said first edge forces said wire into contact with said conductor member; and whereby a wire is removed from the assembly by moving said plug into said first position by the use of said operating groove so that said second edge forces said wire away from said conducting elements and then passing said wire through said lateral passage toward said connecting part.

2. The connector of claim 1 wherein each plug further comprises knife means for trimming said wire, the knife means of each assembly pair being disposed in parallel with each other.

* * * * *

UNITED STATES PATENT AND TRADEMARK OFFICE

CERTIFICATE OF CORRECTION

PATENT NO. : 4,526,434

DATED : July 2, 1985

INVENTOR(S) : YVES SALIGNY

Figure 1:
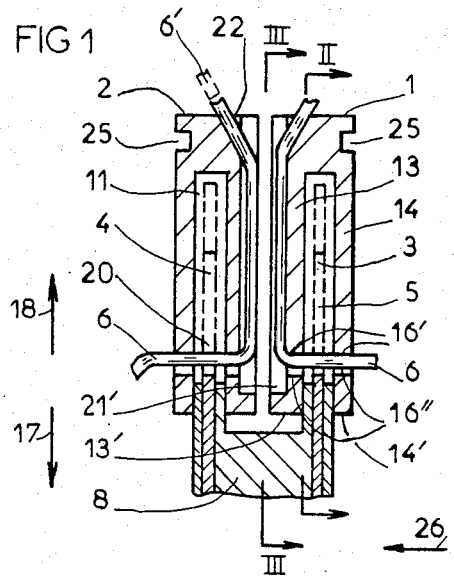
FIG. 1 shows in a cross section I—I of FIG. 2 a first method of executing the connecting element.
Figure 2:
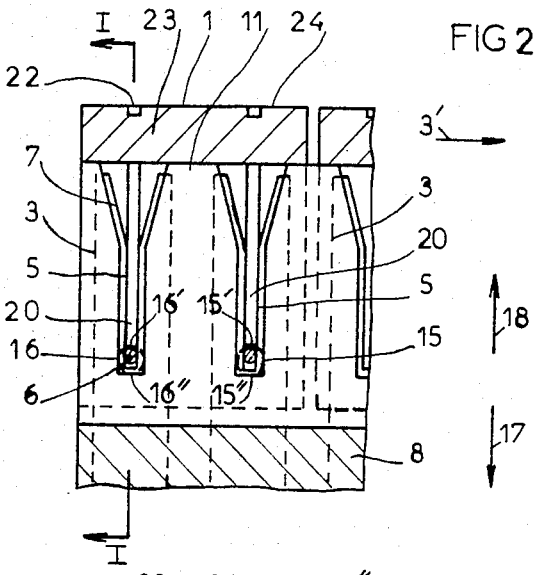
Figure 4:
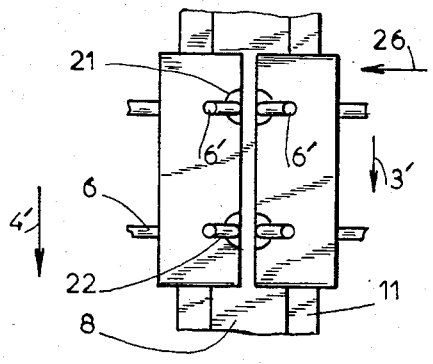
FIG. 4 shows in FIG. 1 viewed from above, the same first method of execution.
Figure 3:
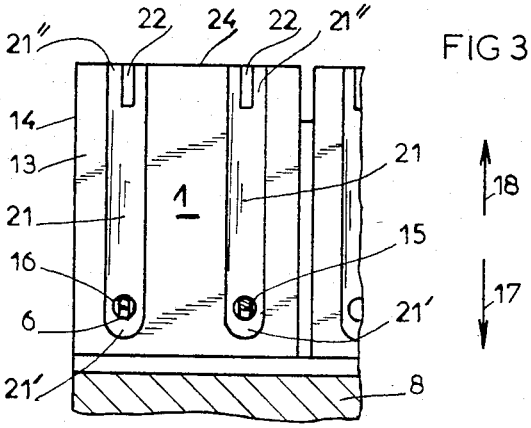
FIG. 3 shows in a cross section II—II of FIG. 1 the same first method of execution.

It is certified that error appears in the above-identified patent and that said Letters Patent is hereby corrected as shown below:

In column 2, line 39, "Fig. 3" should be --Fig. 2--.

In column 7, line 66, after "respective" (second occurrence) insert --edges--.

In colunn 8, line 28, "82" should be --72--.

Signed and Sealed this

*Thirty-first* Day of *December 1985*

[SEAL]

*Attest:*

DONALD J. QUIGG

*Attesting Officer*

*Commissioner of Patents and Trademarks*